US005890930A

United States Patent [19]

Gerow

[11] Patent Number: 5,890,930

[45] Date of Patent: Apr. 6, 1999

[54] REPLACEABLE CONTACT CONNECTOR

[75] Inventor: John Brian Gerow, Oshawa, Canada

[73] Assignee: ITT Manufacturing Enterprises, Inc., Wilmington, Del.

[21] Appl. No.: 156,741

[22] Filed: Nov. 24, 1993

[51] Int. Cl.[6] ..... H01R 13/00

[52] U.S. Cl. ..... 439/651

[58] Field of Search ..... 439/638–640, 439/650–655, 598

[56] References Cited

U.S. PATENT DOCUMENTS

| | | | |
|---|---|---|---|
| 1,605,904 | 11/1926 | Van Brunt . | |
| 2,379,942 | 7/1945 | Webber | 439/578 |
| 2,703,870 | 3/1955 | Minto | 339/94 |
| 2,754,487 | 7/1956 | Carr et al. | 439/578 |
| 3,281,558 | 10/1966 | Weber | 200/129 |
| 3,649,956 | 3/1972 | Vrobel | 339/103 |
| 3,688,244 | 8/1972 | Savoca et al. | 339/60 |
| 3,721,943 | 3/1973 | Curr | 339/94 |
| 3,926,499 | 12/1975 | Bailey et al. | 439/598 |
| 3,933,404 | 1/1976 | Oehlerking et al. | 339/45 |
| 4,077,690 | 3/1978 | Koether | 339/89 |
| 4,653,839 | 3/1987 | Powell | 339/176 |
| 4,904,208 | 2/1990 | Powell et al. | 439/654 |
| 4,909,761 | 3/1990 | Miguira | 439/662 |

*Primary Examiner*—Gary Paumen
*Assistant Examiner*—Tho Dac Ta
*Attorney, Agent, or Firm*—Thomas L. Peterson

[57] ABSTRACT

A connector system is described wherein the most vulnerable parts of the front mating ends of a pair of connectors can be easily replaced in the field. The first connector (12, FIG. 2) includes a shell (20), a main insulator (22) within the shell, and main contacts (24) lying in the main insulator and having socket front ends (30). A first insert module (32) has an insert insulator (36) and insert contacts (38) with pin type rear ends. The first module is inserted into the shell of the first connector to mate with the main contacts. If the front ends (40) of the insert contacts are damaged, the connector can be repaired in the field by merely removing the first module and replacing it with another module. The second connector (14) is similarly constructed, with the modules (36, 36A) of the two connectors being identical so a single spare module can replace either one. The first module that lies in the first connector, has contact front ends forming sockets (40, FIG. 3) which are surrounded by a rigid insulator forming tapered passages (120) that guide pins into the sockets. The second module which lies in the second connector has contacts with pin-type front ends (62A), with the rears of the pins being surrounded by a layer (110) of elastomeric material that has a convex front end (114) to deform against the rigid front face (70) of the first module.

5 Claims, 2 Drawing Sheets

REPLACEABLE CONTACT CONNECTOR

BACKGROUND OF THE INVENTION:

Connectors that are used in a remote harsh environment where they may be subjected to shock and a corrosive and abrasive environment, may have their contact mating front ends damaged. Each connector typically has many contacts that are each securely fastened to the connector insulator, as where the rear ends of the contacts are connected to the wires of a cable that extends rearwardly of the connector. It would be desirable if the mating front ends of the contacts could be replaced in the field without disturbing the rear ends of the contacts.

SUMMARY OF THE INVENTION

In accordance with one embodiment of the present invention, a connector is provided with contact front ends protected by the connector shell, and with the contact front ends being field replaceable without disturbing the contact rear ends. The connector includes a main insulator lying within the shell and main contacts lying within the main insulator and having front ends lying far behind the front end of the shell. A first insert module lies in the shell, with the rear ends of the insert contacts mated with the front ends of the main contacts. The module insulator and module contacts preferably extend no further than the front end of the connector shell to protect them. The insert module is field replaceable, as where it is held by a snap ring accessible from the front end of the connector.

A connector system can include a second connector which is mateable with the first one, and which is of corresponding construction. The second connector has a second shell which surrounds a second insulator and second contacts. A second module fits into the second shell and is field replaceable. The second module is substantially identical to the first module so they can replace one another.

A connector module whose contact front ends are sockets, has a rigid insulator with tapered passages for guiding pins into the sockets. The other connector front end has pins for reception in the sockets, and has an elastomeric layer with a convex front end lying at the rear ends of the pins for pressing against the rigid front end of the first connector.

The novel features of the invention are set forth with particularity in the appended claims. The invention will be best understood from the following description when read in conjunction with the accompanying drawings.

DESCRIPTION OF THE PREFERRED EMBODIMENT

Figures 1, 2:
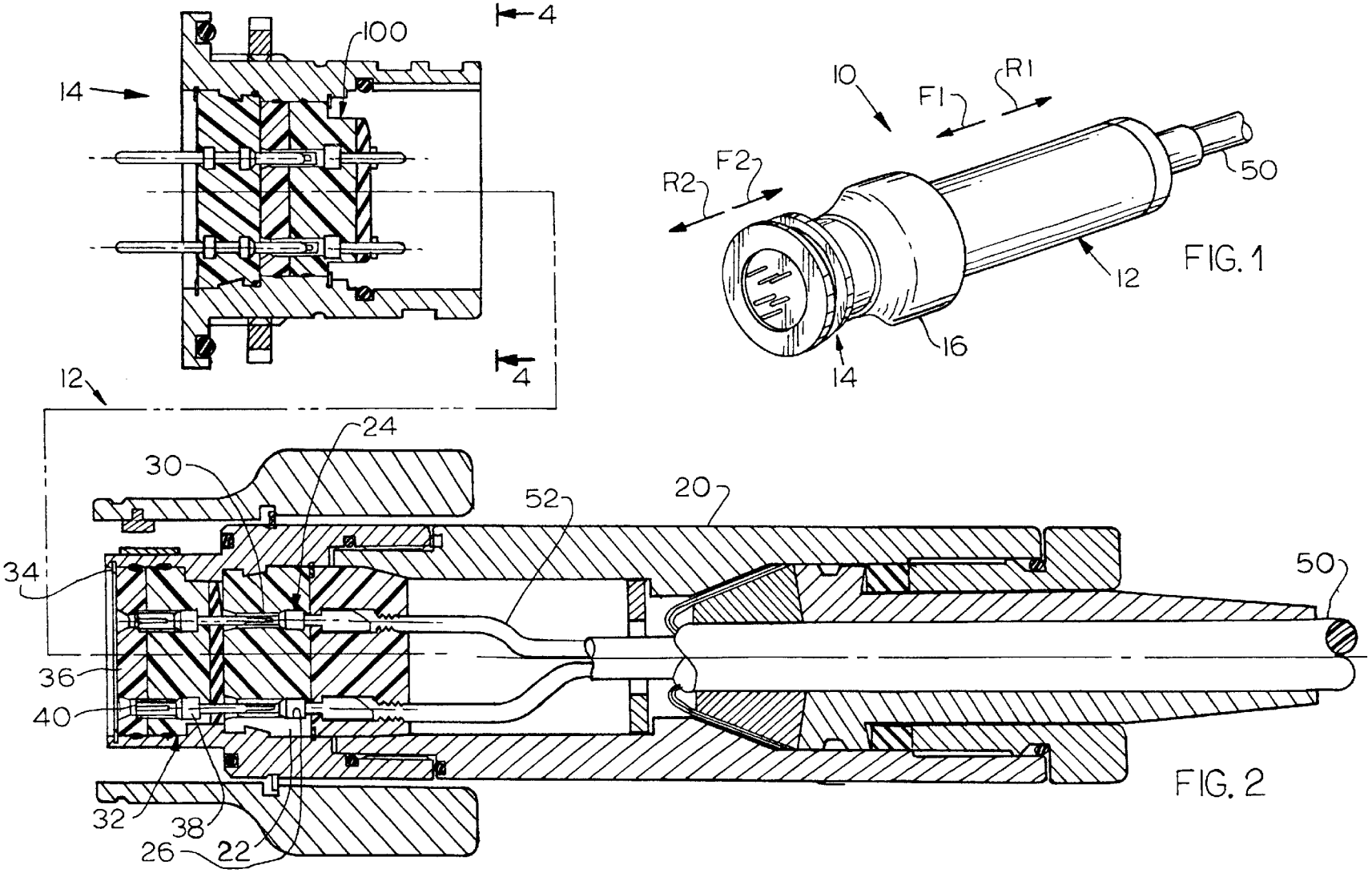
FIG. 1 is an isometric view of a connector system of the present invention, with the first and second connectors shown fully mated.
FIG. 2 is a sectional side view of the connector system of FIG. 1, with the first and second connectors unmated.

FIG. 1 illustrates a connector system 10 which includes first and second connectors 12, 14 which are mated and held together by a coupling nut 16 of the first connector. The connectors are mated by moving them in corresponding forward directions F1, F2 towards each other, and are unmated by moving them in corresponding rearward directions R1, R2 away from each other.

FIG. 2 shows the connectors 12, 14 separated from each other. The first connector 12 includes a first conductive metal shell 20, a first main insulator 22 lying within the shell, and a plurality of first main contacts 24 lying in passages 26 of the main insulator. Each main contact has a front end 30 of a first or female gender, the front end forming a sockel A first insert module 32 lies within the first shell 20, and is held in place thereon by a retainer in the form of a retainer ring 34. The first insert module includes a first insert insulator 36 and a plurality of first insert contacts 38 lying in the insert insulator. Each of the insert contacts 38 mates with the corresponding main contacts, and the insert contacts have front ends in the form of sockets 40.

The connectors are designed for use in hostile environments, where they may be subjected to shocks and corrosive and abrasive material from the environment. The most sensitive parts of the connector are the contact front ends. The socket front ends 40 have relatively delicate spring arms that can be easily bent and that form numerous nooks and crannies that may fill with material from the environment. The surfaces of the socket front ends 40 must be kept clean in order to assure good electrical contact with mating contacts. Damage is especially likely when the front end of the first connector is not connected to the mating second connector. Previously, if the first connector became damaged, it would be necessary to replace the entire assembly of cable 50 and first connector 12, together with another connector (not shown) at the opposite end of the cable. This was necessary largely because each of the cable wires 52 had to be separately threaded through insulation and terminated as by crimping or soldering to individual contacts. The soldering and crimping operations are difficult to perform accurately in the field, and the entire operation involving many contacts was time consuming and prone to poor workmanship when conducted in the field.

Figures 3, 4:
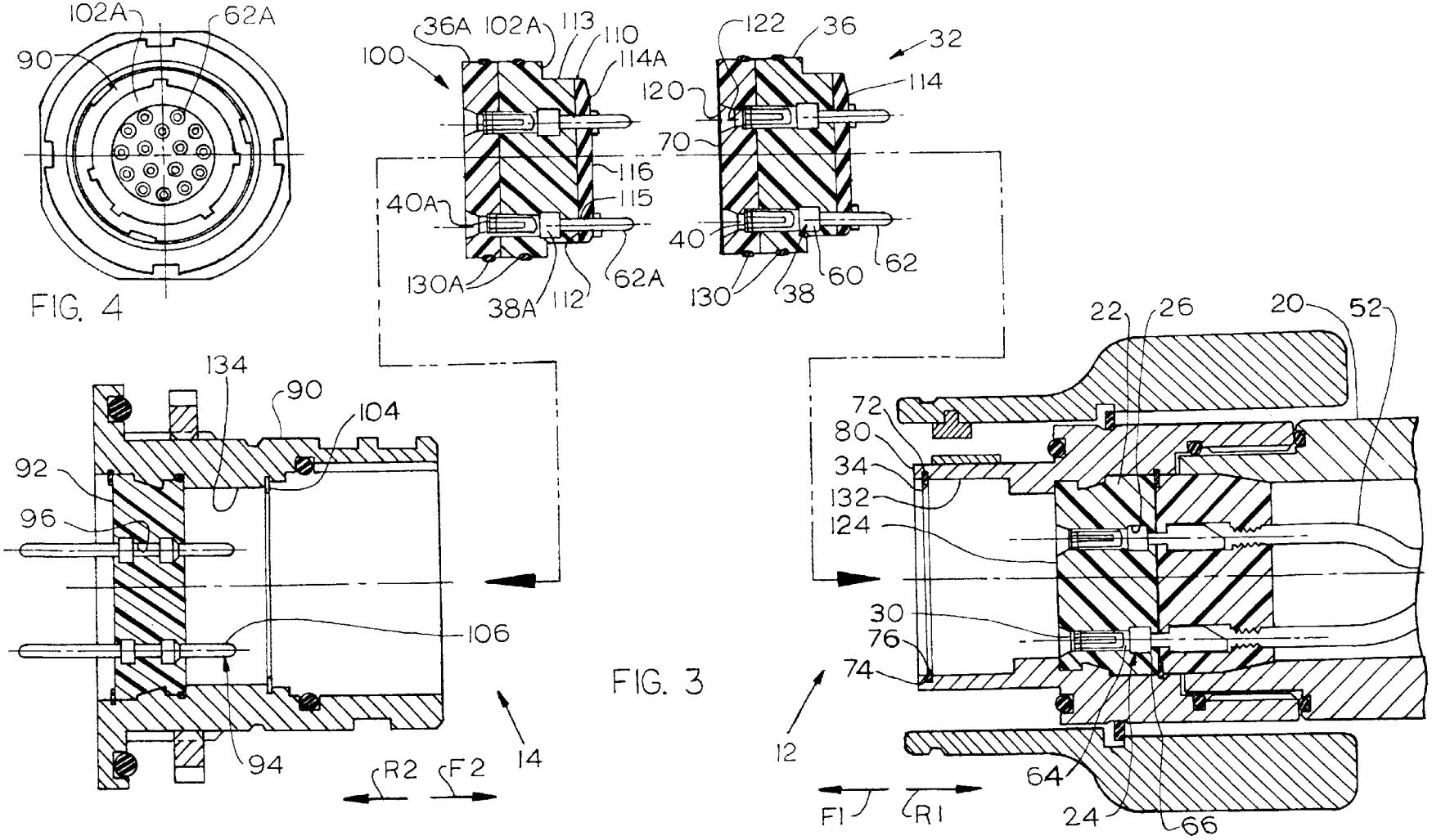
FIG. 3 is an exploded sectional side view of the connector system of FIG. 1, showing the insert module of each connector separate from the rest of the corresponding connector.
FIG. 4 is a view taken on the line 4—4 of FIG. 2.

As shown in FIG. 3, the insert 32 can be readily removed and another one reinstalled in the shell 20 of the first connector 12, and becomes part of the first connector when so installed. The first insert contacts 38 have middle portions 60 anchored in the first insert insulation 36, have pin-type rear ends 62, and have the socket type front ends 40. The pin type rear ends 62 mate with the socket type front ends 30 of the main contacts 24. The main contacts have middle parts 64 anchored in the main insulator 22, and have rear ends 66 connected to conductors of the wires 52 by crimping and/or soldering.

The first insert module 32 is inserted into the shell by first removing the retainer 34, which can be accomplished by a simple tool. The first module is installed in the front end of the shell by merely pressing the first module rearwardly into the shell, to mate the insert and main contacts. The module is pressed rearwardly far enough that the periphery of the module front face 70 lies behind an internal groove 72 in the shell, so the retainer 34 can be installed in the groove. The retainer 34 is of a common snap ring type which is often of "C" shape. Its outer portion 74 holds the retainer in the groove, while its inner portion 76 retains the first module. Substantially the entire insulator 36 of the first module, and preferably also its contacts, lie no further forward than the front tip 80 of the shell, to protect them.

The second connector 14 includes a second shell 90, a second main insulator 92 within the shell, and second main contacts 94 lying within passages 96 of the insulator. The particular second connector 14 is of the header type, with the contacts at its front and rear ends both being pin types; the pins at the front plug into another connector while the pins at the rear terminate to a flexible circuit. The second connector 14 include a second insert module 100 which is of the same construction as the first insert module 32. That is, the second insert module 100 has a second insert insulator 36A and a group of second insert contacts 38A. However, the second insulator contacts have front ends 62A which are of the pin type and correspond to the pin type rear ends 62 of the first insert contacts. Similarly, the second insert contacts have socket type rear ends 40A which correspond to the socket type front ends 40 of the first insert module. The second insert module 100 is inserted into the second shell 90, and has a shoulder 102A which abuts a later-installed retainer ring 104 to hold the second module in place. The second main contacts 94 have pin-type front ends 106 that mate with the rear ends 40A of the second insert contacts. When the first and second connectors mate, the pin-type front ends 62A of the second insert contact are received in the socket type front ends 40 of the first insert contacts.

Applicant prefers to form the second insert insulator 36A primarily of rigid material, but with a layer 110 of elastomeric material at the front end 112 of the rigid material 113 and at the rear 115 of the pin-type contact ends 62A. The elastomeric layer 110 preferably has a convex front face 11 4A with the middle 116 lying most forwardly. As a result of this, when the first and second connectors mate, the convex front face 114 progressively lays against the front face 70 of the first connector module to squeeze out moisture that may have accumulated at the faces. Applicant prefers to form the front face 70 of the first module of rigid material so it can retain tapered pin-guiding front passage portions 120. Such tapered passage portions accurately guide the mating pins at 62A into the sockets, and form barriers at 122 that prevent receipt of an oversize pin that could damage a contact Applicant notes that prior art U.S. Pat. No. 2,703,870 shows mating connectors wherein each have an elastomeric front end portion with a convex face. However, an elastomeric layer at the front of the socket contacts, cannot have an accurately tapered front guide portion 120 or a useful barrier 122 to prevent entrance of oversize contacts. The pin type front ends 62A of the second insert contacts are of relatively short length and are accurately guided, while the elastomeric layer serves to squeeze out moisture in a predictable manner. This construction of an elastomeric layer at the rear of pins, pressing against a rigid insulator with tapered passages leading to sockets, is useful in a wide variety of contact assemblies.

The same elastomer-to-rigid contact occurs when the first module 32 is inserted into the first shell 20 and its rear end 114 presses against the rigid front face 124 of the main insulator. The front faces 70, 124 of the first module and of the first main insulator, are both rigid and even, and preferably flat. A rigid material is one with a Young's Modulus of elasticity of at least 35,000 psi, while an elastomeric material is one which has a Young's Modulus of elasticity of less than 10,000 psi.

Each module carries a pair of peripheral elastomeric seals 130, 130A Each connector shell has a sealed surface 132, 134 lying immediately behind the corresponding retainer ring 34, 104. Each pair of peripheral seals forms a moisture resistant seal against a corresponding shell sealed surface to further exclude corrosive and abrasive material.

The two insert modules 32, 100 are substantially identical, in that one can be substituted for the other. This results in the need to manufacture and store in the field, only one type of insert module. Each insert module is fully protected in the shell of the corresponding connector, by having its insulator and preferably also its contacts lying substantially completely (over 90 percent of their length and preferably 100 percent) within the corresponding shell, in the same manner as prior contacts without replaceable modules.

As mentioned above, each module can be inserted and removed in the field, because the only required tool is a snap ring installation tool. Such snap ring installation tool is similar to an ordinary pliers except that it has pins at its ends for engagement with holes of the snap ring. Operations that generally cannot be performed in the field are multiple soldering or crimping operations, which involve melting or permanent deformation of metal. Operations that merely place or resiliently deform parts using simple tools, generally can be performed in the field.

Thus, the invention provides a connector whose contact front ends can be readily replaced in the field and whose insulator and contact front ends are protected. This is accomplished by constructing the connector with a main insulator and main contacts whose front ends are recessed from the front end of the shell, and by providing an insert module that can fit into the shell front end with the insert contacts mating with the main contacts. A connector system can include two connectors each having an insert module at its front end, and with the insert modules of the two connectors being substantially identical so they can replace one another. Each module insulator comprises primarily rigid engineering plastic, but has a layer of elastomeric material at the rear of the pintype contact ends. A convex face of the elastomeric material presses against the even rigid face of the mating module or connector part whose contact front ends are sockets.

Although particular embodiments of the invention have been described and illustrated herein, it is recognized that modifications and variations may readily occur to those skilled in the art, and consequently, it is intended that the claims be interpreted to cover such modifications and equivalents.

In the claims:

1. A connector which includes a shell, a main insulator lying within said shell with said main insulator having a plurality of main passages, and a plurality of main contacts each having a middle portion lying in one of passages and having a front mateable end of a first gender characterized by:

a first insert module which includes a first insert insulator having insert passages, and a plurality of first insert contacts each having a middle portion lying in one of said insert passages, each first insert contact having a rear end of a second gender which mates with a corresponding one of said main contact front ends, and each first insert contact having a mateable front end;

said first insert module lying substantially completely within said shell, and said first insert module being removable and replaceable therein, said first insert contacts being anchored in said first insert insulator to prevent their removal, so said first insert module can be handled outside said shell, inserted into said shell, and pulled out of said shell, without loss of said first insert contacts.

2. The connector described in claim 1 including:

a second connector which includes a second shell, a second main insulator lying within said second shell with said second main insulator having a plurality of second device passages and a plurality of second main contacts each having a middle portion lying in one of said second main passages and a second contact front end of a second gender;

a second insert module which includes a second insert insulator having passages, and a plurality of second insert contacts each having opposite ends and having a middle portion lying in one of said passages of said second insert insulator;

said first and second insert contacts each have sockets at one end and pins at their opposite ends, with said first front ends of said first insert contacts being pins and being mated to said sockets of said first insert contacts, and with said second front ends of said second insert contacts being sockets and mated to said pins of said second insert, and with said sockets of said first module being mateable to said pins of said second module.

3. The connector device described in claim 2 wherein:

said first and second insert modules are substantially identical in that either one can be substituted for the other.

4. A connector system which includes first and second connectors respectively having first and second shells with front portions, first and second main insulators lying in corresponding ones of said shells, and first and second pluralities of main contacts lying in corresponding ones of said main insulators, wherein said first main contacts have socket-type front ends and said second main contacts have pin type front ends, characterized by:

said connector systems includes first and second insert modules lying respectively in said first and second shell front portions and being removable therefrom, each module having an insert insulator and a plurality of insert contacts;

said first insert contacts have pin-type rear ends mated to said socket-type front ends of said first main contacts, and said first insert contacts have socket-type front ends;

said second insert contacts have socket-type rear ends mated to said pin-type front ends of said second main contacts and said second insert contacts have pin-type front ends;

said first and second insert modules are substantially identical, and the rear end of each is mateable with the front end of the other.

5. The connector system described in claim 4 wherein:

the front of each of said main and insert insulators whose contacts have pin-type front ends, includes an elastomeric layer with a convex front face, and the front of each of said main and insert insulators whose contacts have socket-type front ends, have rigid front ends with tapered front passage portions extending forward of the corresponding socket-type contacts.

* * * * *